US009136634B2

(12) United States Patent
De Geest et al.

(10) Patent No.: US 9,136,634 B2
(45) Date of Patent: Sep. 15, 2015

(54) LOW-CROSS-TALK ELECTRICAL CONNECTOR

(75) Inventors: Jan De Geest, Wetteren (BE); Stefaan Hendrik Jozef Sercu, Wuustwezel (BE); Jonathan E. Buck, Hershey, PA (US); Douglas M. Johnescu, York, PA (US); Stuart C. Stoner, Lewisberry, PA (US); Stephen B. Smith, Mechanicsburg, PA (US)

(73) Assignees: FCI AMERICAS TECHNOLOGY LLC, Carson City, NV (US); FCI, Guyancourt (FR)

( * ) Notice: Subject to any disclaimer, the term of this patent is extended or adjusted under 35 U.S.C. 154(b) by 842 days.

(21) Appl. No.: 13/220,802

(22) Filed: Aug. 30, 2011

(65) Prior Publication Data

US 2012/0058684 A1 Mar. 8, 2012

Related U.S. Application Data

(63) Continuation-in-part of application No. 13/081,323, filed on Apr. 6, 2011, now abandoned.

(60) Provisional application No. 61/379,912, filed on Sep. 3, 2010.

(51) Int. Cl.

| | |
|---|---|
| ***H01R 13/648*** | (2006.01) |
| ***H01R 13/514*** | (2006.01) |
| ***H01R 12/72*** | (2011.01) |
| ***H01R 13/6464*** | (2011.01) |

(52) U.S. Cl.

CPC ..... *H01R 13/514* (2013.01); *H01R 12/724* (2013.01); *H01R 13/6464* (2013.01)

(58) Field of Classification Search

CPC ..... H01R 23/688
USPC ..... 439/607.07, 701, 607.05, 607.11
See application file for complete search history.

(56) References Cited

U.S. PATENT DOCUMENTS

| | | | |
|---|---|---|---|
| 3,286,220 | A | 11/1966 | Marley et al. |
| 3,390,369 | A | 6/1968 | Zavertnik et al. |
| 3,538,486 | A | 11/1970 | Shlesinger, Jr. |

(Continued)

FOREIGN PATENT DOCUMENTS

| | | |
|---|---|---|
| EP | 0273683 | 7/1988 |
| EP | 0891016 | 10/2002 |

(Continued)

OTHER PUBLICATIONS

"Gig-Array High Speed Mezzanine Connectors 15-40 mm Board to Board", FCI Corporation, Jun. 5, 2006, 1 page.

(Continued)

*Primary Examiner* — Neil Abrams
(74) *Attorney, Agent, or Firm* — Baker & Hostetler LLP

(57) ABSTRACT

In one embodiment, an electrical connector includes a plurality of leadframe assembly assemblies, each having a leadframe housing and a plurality of electrical contacts carried by the leadframe housing. At least a pair of adjacent leadframe assemblies includes respective first and second conductive member portions of a conductive bar that reduces cross talk. The first and second portions are each seated in their respective leadframe housings and face each other such that the electrical connector is devoid of electrical contacts between the first and second portions.

22 Claims, 5 Drawing Sheets

(56) References Cited

U.S. PATENT DOCUMENTS 3,587,028 A 6/1971 Uberbacher
3,669,054 A 6/1972 Desso et al.
3,748,633 A 7/1973 Lundergan
4,003,840 A 1/1977 Ishino et al.
4,045,105 A 8/1977 Lee et al.
4,076,362 A 2/1978 Ichimura
4,159,861 A 7/1979 Anhalt
4,260,212 A 4/1981 Ritchie et al.
4,288,139 A 9/1981 Cobaugh et al.
4,383,724 A 5/1983 Verhoeven
4,402,563 A 9/1983 Sinclair
4,482,937 A 11/1984 Berg
4,560,222 A 12/1985 Dambach
4,717,360 A 1/1988 Czaja
4,734,060 A 3/1988 Kawawada et al.
4,776,803 A 10/1988 Pretchel et al.
4,815,987 A 3/1989 Kawano et al.
4,867,713 A 9/1989 Ozu et al.
4,907,990 A 3/1990 Bertho et al.
4,913,664 A 4/1990 Dixon et al.
4,973,271 A 11/1990 Ishizuka et al.
4,997,376 A 3/1991 Buck et al.
5,066,236 A 11/1991 Broeksteeg
5,077,893 A 1/1992 Mosquera et al.
5,098,311 A 3/1992 Roath et al.
5,163,849 A 11/1992 Fogg et al.
5,167,528 A 12/1992 Nishiyama et al.
5,169,324 A 12/1992 Lemke et al.
5,174,770 A 12/1992 Sasaki et al.
5,192,231 A 3/1993 Dolin, Jr.
5,224,867 A 7/1993 Ohtsuki et al.
5,238,414 A 8/1993 Yaegashi et al.
5,254,012 A 10/1993 Wang
5,274,918 A 1/1994 Reed
5,277,624 A 1/1994 Champion et al.
5,286,212 A 2/1994 Broeksteeg
5,302,135 A 4/1994 Lee
5,334,955 A 8/1994 Strnad
5,342,211 A 8/1994 Broeksteeg
5,356,300 A 10/1994 Costello et al.
5,356,301 A 10/1994 Champion et al.
5,357,050 A 10/1994 Baran et al.
5,431,578 A 7/1995 Wayne
5,475,922 A 12/1995 Tamura et al.
5,525,067 A 6/1996 Gatti
5,558,542 A 9/1996 O'Sullivan et al.
5,586,914 A 12/1996 Foster, Jr. et al.
5,590,463 A 1/1997 Feldman et al.
5,609,502 A 3/1997 Thumma
5,641,141 A 6/1997 Goodwin
5,713,746 A 2/1998 Olson et al.
5,730,609 A 3/1998 Harwath
5,741,144 A 4/1998 Elco et al.
5,741,161 A 4/1998 Cahaly et al.
5,795,191 A 8/1998 Preputnick et al.
5,817,973 A 10/1998 Elco
5,853,797 A 12/1998 Fuchs et al.
5,860,816 A * 1/1999 Provencher et al. ..... 439/79
5,908,333 A 6/1999 Perino et al.
5,925,274 A 7/1999 McKinney et al.
5,961,355 A 10/1999 Morlion et al.
5,967,844 A 10/1999 Doutrich et al.
5,971,817 A 10/1999 Longueville
5,980,321 A 11/1999 Cohen et al.
5,993,259 A 11/1999 Stokoe et al.
6,042,389 A 3/2000 Lemke et al.
6,050,862 A 4/2000 Ishii
6,068,520 A 5/2000 Winings et al.
6,099,332 A 8/2000 Troyan
6,116,926 A 9/2000 Ortega et al.
6,116,965 A 9/2000 Arnett et al.
6,123,554 A 9/2000 Ortega et al.
6,125,535 A 10/2000 Chiou et al.
6,129,592 A 10/2000 Mickievicz et al.
6,139,336 A 10/2000 Olson
6,146,157 A 11/2000 Lenoir et al.
6,146,202 A * 11/2000 Ramey et al. ..... 439/607.1
6,146,203 A 11/2000 Elco et al.
6,150,729 A 11/2000 Ghahghahi
6,171,115 B1 1/2001 Mickievicz et al.
6,171,149 B1 1/2001 Van Zanten
6,190,213 B1 2/2001 Reichart et al.
6,212,755 B1 4/2001 Shimada et al.
6,219,913 B1 4/2001 Uchiyama
6,220,896 B1 4/2001 Bertoncini et al.
6,227,882 B1 5/2001 Ortega et al.
6,231,391 B1 5/2001 Ramey et al.
6,252,163 B1 6/2001 Fujimori et al.
6,267,604 B1 7/2001 Mickievicz et al.
6,269,539 B1 8/2001 Takahashi et al.
6,280,209 B1 8/2001 Bassler et al.
6,293,827 B1 9/2001 Stokoe
6,319,075 B1 11/2001 Clark et al.
6,322,379 B1 11/2001 Ortega et al.
6,322,393 B1 11/2001 Doutrich et al.
6,328,602 B1 12/2001 Yamasaki et al.
6,343,955 B2 2/2002 Billman et al.
6,347,952 B1 2/2002 Hasegawa et al.
6,350,134 B1 2/2002 Fogg et al.
6,354,877 B1 3/2002 Shuey et al.
6,358,061 B1 3/2002 Regnier
6,361,366 B1 3/2002 Shuey et al.
6,363,607 B1 4/2002 Chen et al.
6,364,710 B1 4/2002 Billman et al.
6,368,121 B1 4/2002 Ueno et al.
6,371,773 B1 4/2002 Crofoot et al.
6,371,813 B2 4/2002 Ramey et al.
6,375,478 B1 4/2002 Kikuchi
6,379,188 B1 4/2002 Cohen et al.
6,386,914 B1 5/2002 Collins et al.
6,409,543 B1 6/2002 Astbury, Jr. et al.
6,431,914 B1 8/2002 Billman
6,435,913 B1 8/2002 Billman
6,435,914 B1 8/2002 Billman
6,461,202 B2 10/2002 Kline
6,471,548 B2 10/2002 Bertoncini et al.
6,482,038 B2 11/2002 Olson
6,485,330 B1 11/2002 Doutrich
6,494,734 B1 12/2002 Shuey
6,503,103 B1 1/2003 Cohen et al.
6,506,081 B2 1/2003 Blanchfield et al.
6,517,360 B1 2/2003 Cohen
6,520,803 B1 2/2003 Dunn
6,527,587 B1 3/2003 Ortega et al.
6,537,111 B2 3/2003 Brammer et al.
6,540,559 B1 4/2003 Kemmick et al.
6,547,066 B2 4/2003 Koch
6,547,606 B1 4/2003 Johnston et al.
6,554,647 B1 4/2003 Cohen et al.
6,572,410 B1 6/2003 Volstorf et al.
6,602,095 B2 8/2003 Astbury, Jr. et al.
6,609,933 B2 8/2003 Yamasaki
6,641,141 B2 11/2003 Schroeder
6,652,318 B1 11/2003 Winings et al.
6,652,319 B1 11/2003 Billman
6,672,907 B2 1/2004 Azuma
6,692,272 B2 2/2004 Lemke et al.
6,695,627 B2 2/2004 Ortega et al.
6,700,455 B2 3/2004 Tripathi et al.
6,702,590 B2 3/2004 Zaderej et al.
6,717,825 B2 4/2004 Volstorf
6,749,468 B2 * 6/2004 Avery ..... 439/701
6,758,698 B1 7/2004 Caveney et al.
6,762,067 B1 7/2004 Quinones et al.
6,764,341 B2 7/2004 Lappoehn
6,776,649 B2 8/2004 Pape et al.
6,805,278 B1 10/2004 Olson et al.
6,808,399 B2 10/2004 Rothermel et al.
6,824,391 B2 11/2004 Mickievicz et al.
6,843,686 B2 1/2005 Ohnishi et al.
6,848,944 B2 * 2/2005 Evans ..... 439/607.1
6,851,974 B2 2/2005 Doutrich
6,852,567 B1 2/2005 Lee et al.
6,863,543 B2 3/2005 Lang et al.

(56) References Cited

U.S. PATENT DOCUMENTS

| | | | | |
|---|---|---|---|---|
| 6,869,292 | B2 | 3/2005 | Johnescu et al. | |
| 6,890,214 | B2 | 5/2005 | Brown et al. | |
| 6,899,548 | B2 | 5/2005 | Houtz | |
| 6,899,566 | B2 * | 5/2005 | Kline et al. | 439/607.56 |
| 6,905,368 | B2 | 6/2005 | Mashiyama et al. | |
| 6,913,490 | B2 | 7/2005 | Whiteman, Jr. et al. | |
| 6,918,776 | B2 | 7/2005 | Spink, Jr. | |
| 6,918,789 | B2 | 7/2005 | Lang et al. | |
| 6,932,649 | B1 | 8/2005 | Rothermel et al. | |
| 6,945,796 | B2 | 9/2005 | Bassler et al. | |
| 6,953,351 | B2 | 10/2005 | Fromm et al. | |
| 6,969,268 | B2 | 11/2005 | Brunker et al. | |
| 6,969,280 | B2 | 11/2005 | Chien et al. | |
| 6,976,886 | B2 | 12/2005 | Winings et al. | |
| 6,979,202 | B2 | 12/2005 | Benham et al. | |
| 6,979,226 | B2 | 12/2005 | Otsu et al. | |
| 6,981,883 | B2 | 1/2006 | Raistrick et al. | |
| 6,988,902 | B2 | 1/2006 | Winings et al. | |
| 6,994,569 | B2 | 2/2006 | Minich et al. | |
| 7,057,115 | B2 | 6/2006 | Clink et al. | |
| 7,083,432 | B2 * | 8/2006 | Hull et al. | 439/79 |
| 7,097,506 | B2 | 8/2006 | Nakada | |
| 7,118,391 | B2 | 10/2006 | Minich et al. | |
| 7,131,870 | B2 | 11/2006 | Whiteman, Jr. et al. | |
| 7,157,250 | B2 | 1/2007 | San Gabriel et al. | |
| 7,163,421 | B1 | 1/2007 | Cohen et al. | |
| 7,182,643 | B2 | 2/2007 | Winings et al. | |
| 7,207,807 | B2 | 4/2007 | Fogg | |
| 7,229,318 | B2 | 6/2007 | Winings et al. | |
| 7,320,621 | B2 | 1/2008 | Laurx et al. | |
| 7,331,800 | B2 | 2/2008 | Winings et al. | |
| 7,347,740 | B2 | 3/2008 | Minich | |
| 7,371,117 | B2 | 5/2008 | Gailus | |
| 7,384,311 | B2 | 6/2008 | Sharf et al. | |
| 7,387,535 | B2 | 6/2008 | Minich | |
| 7,407,413 | B2 | 8/2008 | Minich | |
| 7,422,484 | B2 | 9/2008 | Cohen et al. | |
| 7,442,054 | B2 | 10/2008 | Lemke et al. | |
| 7,462,924 | B2 | 12/2008 | Shuey | |
| 7,473,138 | B2 | 1/2009 | Tuin et al. | |
| 7,497,736 | B2 | 3/2009 | Minich et al. | |
| 7,524,209 | B2 | 4/2009 | Hull et al. | |
| 7,534,142 | B2 * | 5/2009 | Avery et al. | 439/607.05 |
| 7,581,990 | B2 | 9/2009 | Kirk et al. | |
| 7,588,463 | B2 | 9/2009 | Yamada et al. | |
| 7,663,516 | B1 | 2/2010 | Chandra | |
| 7,708,569 | B2 | 5/2010 | Sercu et al. | |
| 7,713,088 | B2 | 5/2010 | Sercu et al. | |
| 7,727,017 | B2 | 6/2010 | Amleshi et al. | |
| 7,753,731 | B2 | 7/2010 | Cohen et al. | |
| 7,789,676 | B2 | 9/2010 | Morgan et al. | |
| 7,789,705 | B2 | 9/2010 | Morgan | |
| 7,794,278 | B2 | 9/2010 | Cohen et al. | |
| 7,798,852 | B2 | 9/2010 | Laurx et al. | |
| 7,806,729 | B2 | 10/2010 | Nguyen et al. | |
| 7,819,697 | B2 | 10/2010 | Glover et al. | |
| 7,867,031 | B2 | 1/2011 | Amleshi et al. | |
| 7,878,853 | B2 | 2/2011 | Amleshi et al. | |
| 7,887,371 | B2 | 2/2011 | Kenny et al. | |
| 7,914,304 | B2 | 3/2011 | Cartier et al. | |
| 7,976,318 | B2 | 7/2011 | Fedder et al. | |
| 8,011,957 | B2 | 9/2011 | Pan | |
| 8,123,563 | B2 | 2/2012 | Kenny et al. | |
| 8,147,254 | B2 | 4/2012 | Shuey et al. | |
| 8,157,591 | B2 | 4/2012 | Fedder | |
| 8,182,289 | B2 | 5/2012 | Stokoe et al. | |
| 8,231,415 | B2 | 7/2012 | Johnescu et al. | |
| 8,262,412 | B1 | 9/2012 | Minnick et al. | |
| 8,267,721 | B2 * | 9/2012 | Minich | 439/607.05 |
| 8,361,896 | B2 * | 1/2013 | De Geest | 438/607 |
| 8,366,485 | B2 | 2/2013 | Johnescu et al. | |
| 8,398,431 | B1 * | 3/2013 | Whiteman et al. | 439/607.06 |
| 8,430,691 | B2 | 4/2013 | Davis | |
| 8,460,032 | B2 | 6/2013 | Kirk | |
| 8,469,745 | B2 * | 6/2013 | Davis et al. | 439/607.07 |
| 8,500,487 | B2 * | 8/2013 | Morgan et al. | 439/607.06 |
| 8,506,330 | B2 * | 8/2013 | Mizukami et al. | 439/607.07 |
| 8,540,525 | B2 * | 9/2013 | Regnier et al. | 439/79 |
| 8,690,604 | B2 * | 4/2014 | Davis | 439/607.07 |
| 8,715,003 | B2 * | 5/2014 | Buck et al. | 439/607.07 |
| 8,747,158 | B2 * | 6/2014 | Szczesny et al. | 439/607.07 |
| 8,771,017 | B2 * | 7/2014 | Vino et al. | 439/607.56 |
| 8,771,023 | B2 * | 7/2014 | De Bruijn | 439/701 |
| 8,814,595 | B2 * | 8/2014 | Cohen et al. | 439/607.07 |
| 8,894,442 | B2 * | 11/2014 | McClellan et al. | 439/607.05 |
| 8,944,831 | B2 * | 2/2015 | Stoner et al. | 439/108 |
| 8,961,228 | B2 * | 2/2015 | Jeon | 439/607.07 |
| 8,961,229 | B2 * | 2/2015 | Pan | 439/607.07 |
| 8,992,253 | B2 * | 3/2015 | McClellan et al. | 439/607.05 |
| 2001/0012730 | A1 | 8/2001 | Ramey et al. | |
| 2002/0098727 | A1 | 7/2002 | McNamara et al. | |
| 2002/0142629 | A1 | 10/2002 | Zaderej et al. | |
| 2003/0143894 | A1 | 7/2003 | Kline et al. | |
| 2003/0220021 | A1 | 11/2003 | Whiteman, Jr. et al. | |
| 2004/0121652 | A1 | 6/2004 | Gailus | |
| 2004/0127098 | A1 | 7/2004 | Kuo et al. | |
| 2005/0009402 | A1 | 1/2005 | Chien et al. | |
| 2005/0118869 | A1 | 6/2005 | Evans | |
| 2005/0170700 | A1 | 8/2005 | Shuey et al. | |
| 2005/0221677 | A1 | 10/2005 | Hammond et al. | |
| 2005/0277221 | A1 | 12/2005 | Mongold et al. | |
| 2006/0014433 | A1 | 1/2006 | Consoli et al. | |
| 2006/0046526 | A1 | 3/2006 | Minich | |
| 2006/0192274 | A1 | 8/2006 | Lee et al. | |
| 2006/0234531 | A1 | 10/2006 | Winings et al. | |
| 2007/0004282 | A1 | 1/2007 | Cohen et al. | |
| 2007/0099455 | A1 | 5/2007 | Rothermel et al. | |
| 2007/0205774 | A1 | 9/2007 | Minich | |
| 2007/0207641 | A1 | 9/2007 | Minich | |
| 2008/0085618 | A1 | 4/2008 | Sercu et al. | |
| 2008/0176453 | A1 | 7/2008 | Minich et al. | |
| 2008/0194146 | A1 | 8/2008 | Gailus | |
| 2008/0203547 | A1 | 8/2008 | Minich | |
| 2009/0130912 | A1 | 5/2009 | Shuey et al. | |
| 2009/0159314 | A1 | 6/2009 | Minich et al. | |
| 2009/0191756 | A1 | 7/2009 | Hull et al. | |
| 2009/0221165 | A1 | 9/2009 | Buck et al. | |
| 2009/0291593 | A1 * | 11/2009 | Atkinson et al. | 439/607.06 |
| 2011/0159744 | A1 | 6/2011 | Buck | |
| 2011/0230096 | A1 | 9/2011 | Atkinson et al. | |
| 2011/0256763 | A1 * | 10/2011 | De Geest et al. | 439/607.01 |
| 2012/0058684 | A1 * | 3/2012 | De Geest et al. | 439/660 |
| 2012/0135641 | A1 * | 5/2012 | Okuyama et al. | 439/626 |
| 2012/0214344 | A1 | 8/2012 | Cohen et al. | |
| 2013/0224999 | A1 | 8/2013 | Jeon | |

FOREIGN PATENT DOCUMENTS

| | | |
|---|---|---|
| EP | 1148587 | 4/2005 |
| JP | 6236788 | 8/1994 |
| JP | 7114958 | 5/1995 |
| JP | 11185886 | 7/1999 |
| JP | 2000/003743 | 1/2000 |
| JP | 2000/003744 | 1/2000 |
| JP | 2000/003745 | 1/2000 |
| JP | 2000/003746 | 1/2000 |
| WO | WO 90/16093 | 12/1990 |
| WO | WO 01/29931 | 4/2001 |
| WO | WO 01/39332 | 5/2001 |
| WO | WO 02/101882 | 12/2002 |
| WO | WO 2006/031296 | 3/2006 |
| WO | WO 2008/005122 | 1/2008 |
| WO | WO 2008/045269 A2 | 4/2008 |
| WO | WO 2008/106001 | 9/2008 |
| WO | WO 2012/031172 | 3/2012 |

OTHER PUBLICATIONS

Goel et al., "AMP Z-Pack Interconnect System", AMP Incorporated, 1990, 9 pages.

"HDM Separable Interface Detail", Molex, Feb. 17, 1993, 3 pages.

"HDM Stacker Signal Integrity", http://www.teradyne.com/prods/tcs/products/connectors/mezzanine/hdm_stacker/signintegrity.html, Amphenol TCS (ATCS), Feb. 2, 2006, 3 pages.

(56) References Cited

OTHER PUBLICATIONS

"HDM, HDM Plus Connectors", http:13 www.teradyne.com-prods-tcs-products-connectors-backplane-hdm-index.html, Amphenol TCS, 2006, 1 page.
"HDM/HDM Plus, 2mm, Backplane Interconnection System", Teradyne Connection Systems, 1993, 22 pages.
"Honda High-Speed Backplane Connector NSP Series", Honda Connectors, Feb. 7, 2003, 25 pages.
Hult, "FCI's Problem Solving Approach Changes Market, The FCI Electronics AirMax VS", http:—www.connecotrsupplier.com-tech_updates_FCI-Airmax_archive.htm, ConnectorSupplier.com, 2006, 1-4.
International Patent Application No. PCT/US2010/061477: International Search Report dated Sep. 27, 2011, 9 pages.
International Patent Application No. PCT/US2011/031503: International Search Report dated Dec. 23, 2011, 9 pages.
"Lucent Technologies' Bell Labs and FCI Demonstrate 25gb-S Data Transmission Over Electrical Backplane Connectors", http:—www.lucent.com-press-0205-050201.bla.html, Lucent Tech Bell Labs, Feb. 1, 2005,1-4.
"Metral 2mm High-Speed Connectors, 1000, 2000, 3000 Series, Electrical Performance Data for Differential Applications", FCI Framatome Group, 2 pages.
"Metral Speed & Density Extensions", FCI, Jun. 3, 1999, 1-25.
"Mezzanine High Speed High-Density Connectors Gig-Array and Meg-Array Electrical Performance Data", FCI Corporation, 10 pages.
U.S. Appl. No. 61/092,268, filed Aug. 27, 2008, Minich.
U.S. Appl. No. 61/291,136, filed Dec. 30, 2009, Buck.
U.S. Appl. No. 61/321,667, filed Apr. 7, 2010, De Geest.
"4.0 UHD Connector Differential Signal Crosstalk, Reflections", 1998, p. 8-9.
"AMP Z-Dok and Z-Dok and Connectors", Tyco Electronics/AMP, Application Specification #114-13068, Aug. 30, 2005, 17 pages.
"AMP Z-Pack 2mm HM Connector, 2mm Centerline, Eight-Row, Right-Angle Applications", Electrical Performance Report, EPR 889065, Issued Sep. 1998, 59 pages.
"AMP Z-Pack 2mm HM Interconnection System", 1992/994, AMP Incorporated, 6 pages.
"AMP Z-Pack HM-ZD Performance at Gigabit Speeds", Tyco Electronics, Report #20GC014, Rev.B., May 4, 2001, 32 pages.
"B.? Bandwidth and Rise Time Budgets, Module 1-8 Fiber Optic Telecommunications (E-XVI-2a)", http:—cord.orq-step_online-st1-8-st18exvi2a.htm, 2006, 1-3.
"Champ Z-Dok Connector System", Tyco Electronics, Jan. 2002, 3 pages.
"FCI's Airmax VS Connector System Honored at DesignCon 2005", http:—www.heilind.com-products-fci-airmax-vs-design.asp, Heilind Electronics, Inc., 2005, 1 page.
"Framatome Connector Specification", May 10, 1999, 1 page.
Fusi et al., "Differential Signal Transmission through Backplanes and Connectors", Electronic Packaging and Production, Mar. 1996, 27-31.
"GbXI-Trac Backplane Connector System", www.molex.com/cgi-bin, Molex, 2007, 1-3.
"Gig-Array Connector System, Board to Board Connectors", 2005, 4 pages.
"HDM Stacker Signal Integrity", http://www.teradyne.com/prods/tcs/products/connectors/rnezzanine/hdm_stacker/signintegrity.html, Amphenol TCS (ATCS), Feb. 2, 2006, 3 pages.
"HDM, HDM Plus Connectors", http:—www.teradyne.com-prods-tcs-products-connectors-backplane-hdm-index.html, Amphenol TCS, 2006, 1 page.
"Lucent Technologies' Bell Labs and FCI Demonstrate 25gb-S Data Transmission Over Electrical Backplane Connectors", http:—www.lucent.com-press-0205-050201.bla.html, Lucent Tech Bell Labs, Feb. 1, 2005, 1-4.
"MILLIPACS Connector, Type A Specification", Dec. 14, 2004, 1 page.
Nadolny et al., "Optimizing Connector Selection for Gigabit Signal Speeds", http:—www.ecurnag.com-article-CA45245, ECN, Sep. 1, 2000, 6 pages.
"NSP Series, Backplane High-Speed Data Transmission Cable Connectors", http:—www.honda-connector co.jp, Honda Connectors, 2006, 6 pages, English Translation attached.
"Overview: Backplane Products", http:—www.molex.com-cgi-bin-bv-molex-super_family-super_family.jsp?BV_SessonID=@, Molex, 2008, 1-3.
"PCB-Mounted Receptacle Assemblies, 2.00 mm (0.079 In) Centerlines, Right-Angle Solder-to-Board Signal Receptacle", Metral , Berg Electronics, 2005, 2 pages.
"Perspective View of Gigarray IMLA", 1998, 1 page.
"VHDM Connector", http://www.teradyne.com/prods/tcs/products/connectors/backplane/vhdm/index.html, Amphenol TCS (ATCS), Jan. 31, 2006, 2 pages.
"VHDM Daughterboard Connectors Feature Press-Fit Terminations and a Non-Stubbing Separable Interface", Teradyne, Inc. Connections Sys Div, Oct. 8, 1997, 46 pages.
"VHDM High-Speed Differential (VHDM HSD)", http://www.teradyne.com/prods/bps/vhdm/hsd.html, Teradyne, Jan. 24, 2000, 6 pages.
"VHDM L-Series Connector", http://www.teradyne.com/prods/tcs/products/connectors/backplane/vhdm_1-series/index.html, Amphenol TCS(ATCS), 2006, 4 pages.
"Z-Dok and Connector", http://2dok.tyco.electronics.com, Tyco Electronics, May 23, 2003, 1-15.

* cited by examiner

LOW-CROSS-TALK ELECTRICAL CONNECTOR

CROSS-REFERENCE TO RELATED APPLICATIONS

This is a continuation-in-part of U.S. patent application Ser. No. 13/081,323 filed Apr. 6, 2011, now abandoned, the disclosure of which is hereby incorporated by reference as if set forth in its entirety herein. This also claims the benefit of U.S. Patent Application Ser. No. 61/379,912 filed Sep. 3, 2010, the disclosure of which is hereby incorporated by reference as if set forth in its entirety herein.

TECHNICAL FIELD

The present disclosure relates generally to the field of electrical connectors, and in particular relates to an electrical connector that is configured to reduce cross-talk between adjacent signal contacts.

BACKGROUND

Electrical connectors provide signal connections between electronic devices using electrically-conductive contacts, or electrical contacts. In some applications, an electrical connector provides a connectable interface between one or more substrates, e.g., printed circuit boards. Such an electrical connector may include a receptacle connector mounted to a first substrate and a complementary header connector mounted to a second substrate. Typically, a first plurality of electrical receptacle contacts in the receptacle connector is adapted to mate with a corresponding plurality of electrical header contacts in the header connector. For instance, the electrical receptacle contacts can receive the electrical header contacts so as to establish an electrical connection between the electrical receptacle contacts and the electrical header contacts.

The electrical contacts typically include a plurality of signal contacts and ground contacts. Often, the signal contacts are so closely spaced that undesirable interference, or "cross talk," occurs between adjacent signal contacts. As used herein, the term "adjacent" refers to contacts (or rows or columns) that are next to one another. Cross talk occurs when one signal contact induces electrical interference in an adjacent signal contact due to intermingling electrical fields, thereby compromising signal integrity. With electronic device miniaturization and high speed, high signal integrity electronic communications becoming more prevalent, the reduction of cross talk becomes a significant factor in connector design.

SUMMARY

In accordance with one embodiment, an electrical connector includes a connector housing, a first leadframe assembly supported by the connector housing, and a second leadframe supported by the connector housing. The first leadframe assembly includes a first leadframe housing and a corresponding plurality of electrical contacts carried by the first leadframe housing. The second leadframe assembly that is adjacent to the first leadframe assembly and includes a second leadframe housing and a corresponding plurality of electrical contacts carried by the second leadframe housing. The electrical connector further includes an electrically conductive member including a first portion and a second portion configured to engage the first portion. The first portion is supported by the first leadframe housing so as to define a gap with respect to the plurality of electrical contacts corresponding to the first leadframe assembly, and the second portion carried by the second leadframe housing so as to define a gap with respect to the plurality of electrical contacts corresponding to the second leadframe assembly. The first and second portions face each other when the first and second leadframe assemblies are supported by the connector housing.

DETAILED DESCRIPTION

Figure 1A:
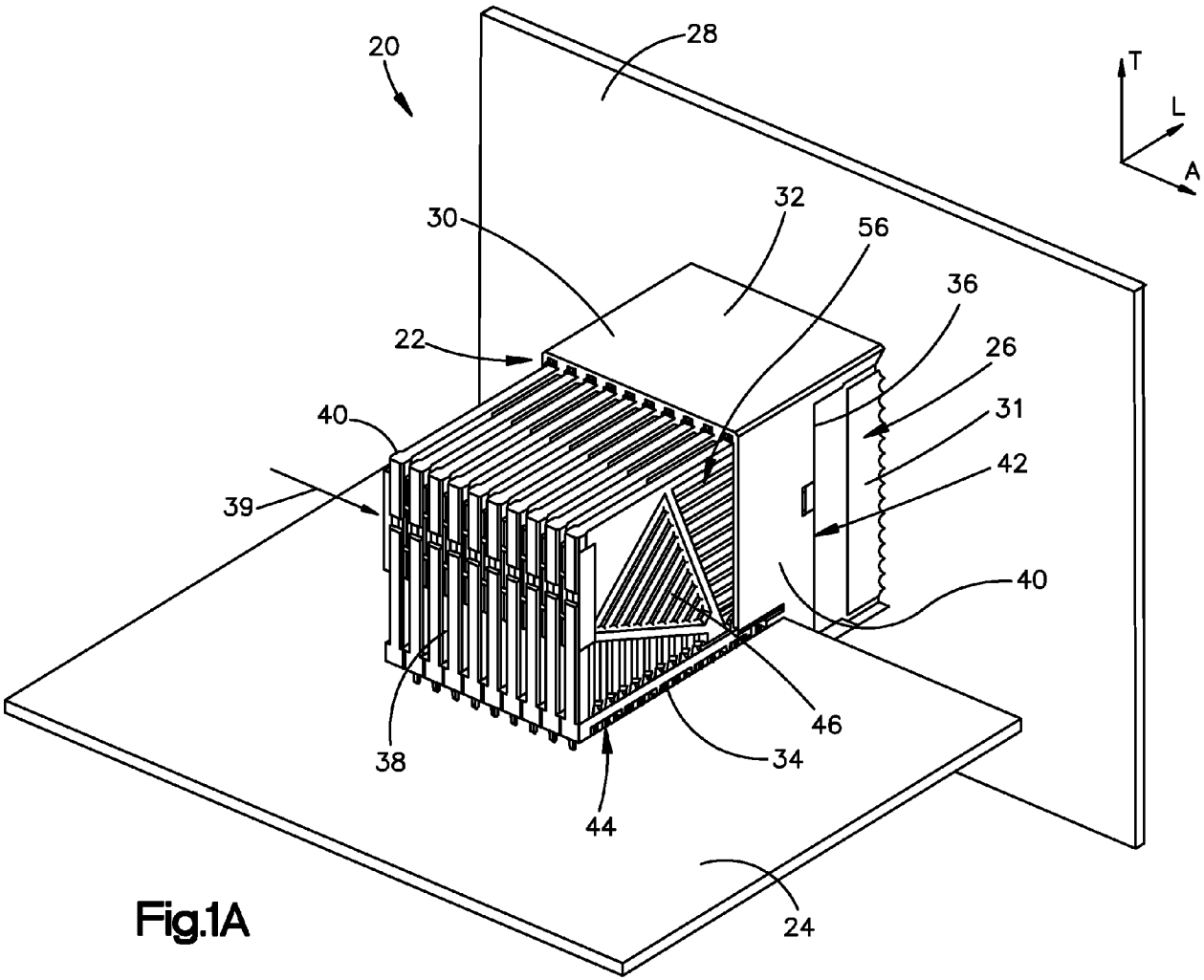
FIG. 1A is a perspective view of an electrical connector assembly including a first electrical connector and a second electrical connector that can each be mounted to respective printed circuit boards and mated so as to place the printed circuit boards in electrical communication.
Figure 1B:
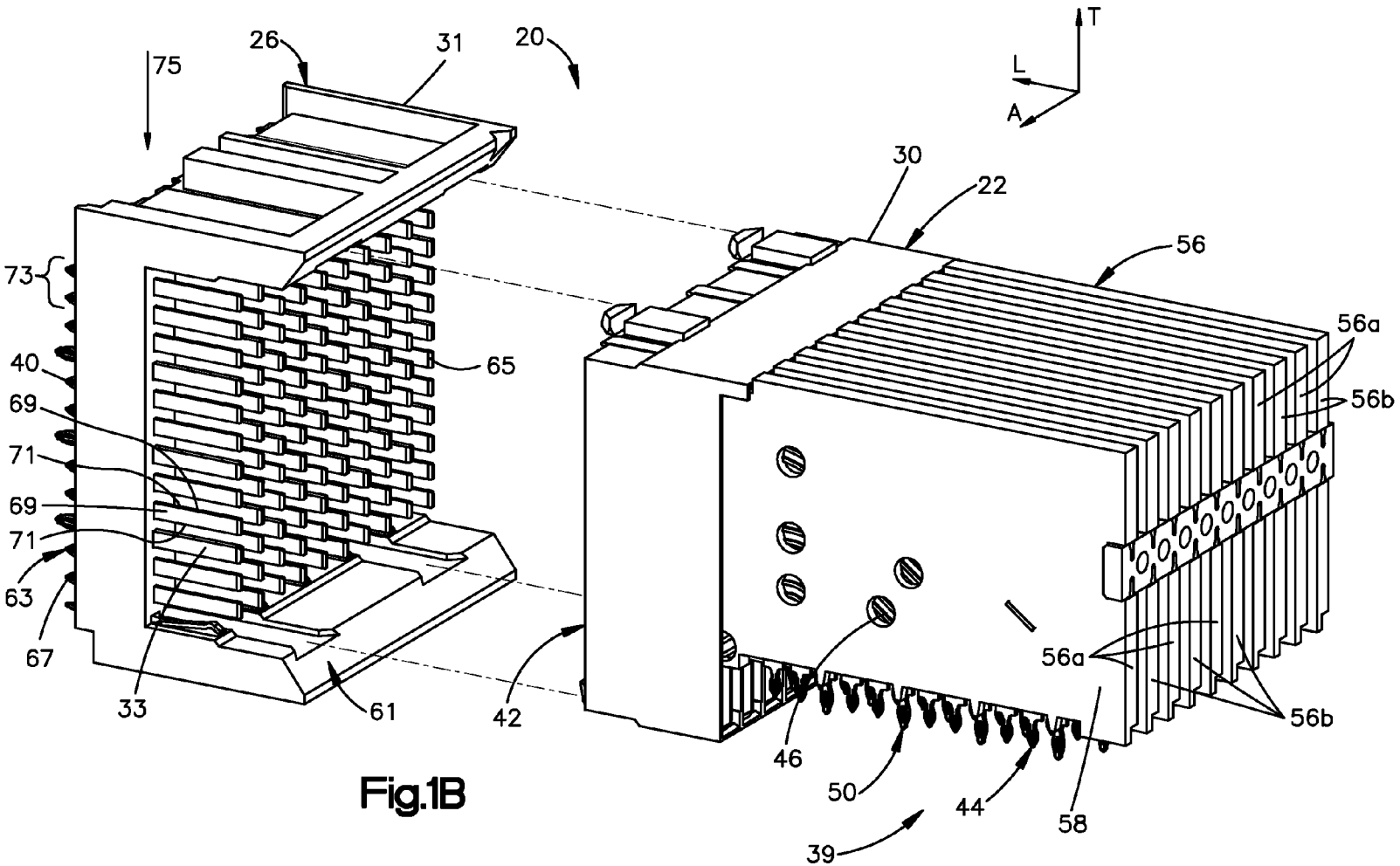
FIG. 1B is a perspective view of the electrical connector assembly illustrated in FIG. 1A, showing the first and second electrical connectors aligned to be mated with each other.

Referring to FIGS. 1A-B, an electrical connector system 20 includes a first electrical connector 22 configured to be electrically connected to a first substrate 24 which can be provided as a printed circuit board (PCB), and a second electrical connector 26 configured to be electrically connected to a second substrate 28 such as a PCB. The first and second electrical connectors 22 and 26 are configured to mate with each other so as to place the first and second substrates 24 and 28 in electrical communication with each other. The electrical connector system 20 can be constructed generally as described in U.S. Pat. No. 7,331,800, the disclosure of which is hereby incorporated by reference as if set forth in its entirety herein.

The first electrical connector 22 includes a connector housing 30 that is dielectric or electrically insulative. Housing 30 may also be made from a frequency absorber, such as an electrically conductive or electrically insulative lossy material. The housing may have vertical ribs that separate leadframe assemblies 56, or may be devoid of the ribs. The first electrical connector 22 defines a top end 32 and an opposed bottom end 34, a front end 36 and an opposed rear end 38, and opposed sides 40. The opposed front and rear ends 36 and 38 are spaced apart along a longitudinal direction L, the opposed sides 40 are spaced apart along a lateral direction A that is substantially perpendicular with respect to the longitudinal direction L, and the top and bottom ends 32 and 34 are spaced apart along a transverse direction T that is substantially perpendicular with respect to the lateral direction A and the longitudinal direction L. In accordance with the illustrated embodiment, the transverse direction T is oriented vertically, and the longitudinal and lateral directions L and A are oriented horizontally, though it should be appreciated that the orientation of the first electrical connector 22 may vary during use. In accordance with the illustrated embodiment, the first and second electrical connectors 26 are configured to be mated with each other along a mating direction M, which can extend along the longitudinal direction L.

The first electrical connector 22 defines a mating interface 42 disposed proximate to the front end 36 and a mounting interface 44 disposed proximate to the bottom end 34. The mounting interface 44 is configured to operatively engage the first substrate 24, while the mating interface 42 is configured to operatively engage the second electrical connector 26. As shown, the first electrical connector 22 can be a right-angle electrical connector, whereby the mating interface 42 and the mounting interface 44 are oriented substantially perpendicular to each other, though it should be appreciated that the first electrical connector can alternatively be a vertical connector whereby the mating interface 42 and the mounting interface 44 are oriented substantially parallel to each other.

The first electrical connector 22 includes a plurality of electrical contacts 46 that are electrically conductive and supported by the connector housing 30. In accordance with the illustrated embodiment, the first electrical connector 22 includes a plurality of leadframe assemblies 56 that are arranged along a laterally extending row direction 39. The plurality of leadframe assemblies 56 can include a plurality of first leadframe assemblies 56*a* and a plurality of second leadframe assemblies 56*b* that are alternatingly arranged along the row direction 39. Thus, each of the first leadframe assemblies 56*a* can be disposed between a pair of second leadframe assemblies 56*b* or adjacent a second leadframe assembly 56*b*. Likewise, each of the second leadframe assemblies 56*b* can be disposed between a pair of first leadframe assemblies 56*a* or adjacent a first leadframe assembly 56*a*. Each of the plurality of first leadframe assemblies 56*a* can have a first electrical contact arrangement, and each of the plurality of second leadframe assemblies 56*b* can have a second electrical contact arrangement that differs from the first contact arrangement of each of the plurality of first leadframe assemblies 56*a*. Alternatively, the first and second leadframe assemblies 56*a* and 56*b* can define the same arrangement of electrical contacts.

Figure 2B:
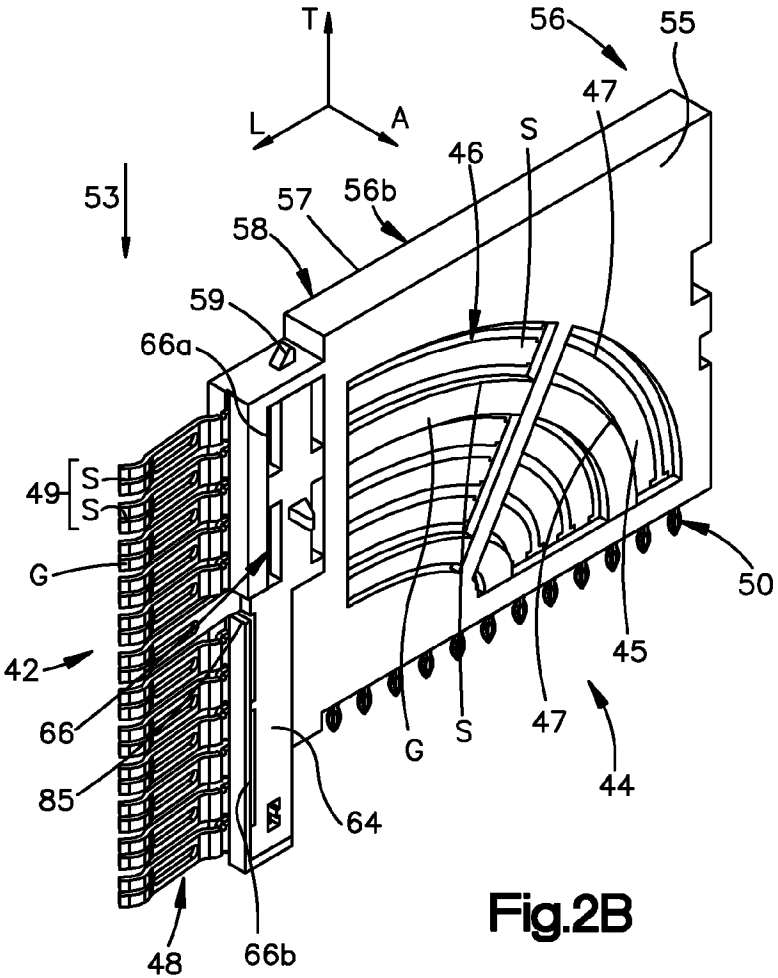
FIG. 2B is a perspective view of a second leadframe assembly including a second portion of the electrically conductive bar illustrated in FIG. 2A.
Figure 2A:
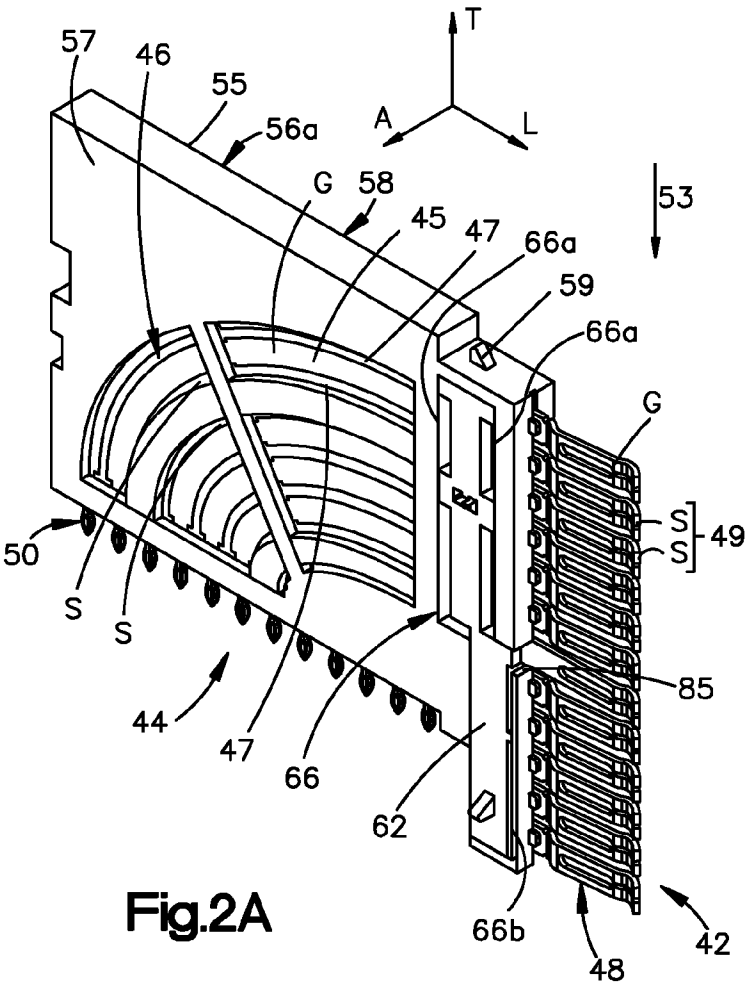
FIG. 2A is a perspective view of a first leadframe assembly including a first portion of an electrically conductive bar.

Referring also to FIGS. 2A-B, each leadframe assembly 56 can include a leadframe housing 58 that can be a dielectric or electrically insulative material. Each leadframe housing 58 can support a respective plurality of the electrical contacts 46 arranged along corresponding common transverse columns LC. The leadframe housing 58 of each leadframe assembly 56 defines laterally opposed first and second outer surfaces 55 and 57 that are spaced apart along the row direction 39, such that the first outer surface 55 of a first one of the leadframe housings 58 of a first select one of the leadframe assemblies 56 faces the second outer surface 57 of a second select one of the leadframe housings 58 of a second one of the leadframe assemblies 56 that is adjacent the first select one of the leadframe assemblies 56. The first select one of the leadframe assemblies 56 can be a first leadframe assembly 56*a* or a second leadframe assembly 56*b*, and the second select one of the leadframe assemblies 56 can be the other of the first leadframe assembly 56*a* and the second leadframe assembly 56*b*.

In accordance with one embodiment, the leadframe assemblies 56 can be insert molded leadframe assemblies (IMLAs) whereby the respective electrical contacts 46 are overmolded by the corresponding leadframe housing 58. Alternatively, the electrical contacts 46 can be stitched or otherwise fixed in the respective leadframe housing 58. The leadframe housings 58 include engagement members illustrated as tabs 59 that are configured to engage respective engagement members of the connector housing 30 so as to secure the position of the respective leadframe housings 58 in the connector housing 30.

The electrical contacts 46 can include a plurality of signal contacts S that are configured to carry and transmit data signals to the complementary second electrical connector 26, and a plurality of ground contacts G. Any suitable dielectric material, such as air or plastic, may be used to isolate the electrical signal contacts 46 of one leadframe assembly 56 from an adjacent leadframe assembly 56. The electrical contacts 46 each define respective mating ends 48 that extend along the mating interface 42, and extend laterally forward from the leadframe housing 58 and are configured to mate with complementary mating ends of the electrical contacts of the second electrical connector 26. The electrical contacts 46 further define opposed mounting ends 50 that extend along the mounting interface 44. The mounting ends 50 may be press-fit tails, surface mount tails, or fusible elements such as solder balls, which are configured to electrically connect to a complementary electrical component such as the first substrate 24, which can be configured as a backplane, midplane, daughtercard, or the like. The electrical contacts 46 can be right-angle electrical contacts, whereby the mounting ends 50 extend in a direction substantially perpendicular to the mating ends 48. Alternatively, the electrical contacts 46 can be vertical electrical contacts, whereby the mounting ends 50 extend in a direction substantially parallel to the mating ends 48.

Each of the electrical contacts 46 can define respective first and second opposed broadsides 45 and first and second edges 47 connected between the broadsides. The edges 47 define a length less than that of the broadsides 45, such that the electrical contacts 46 define a rectangular cross section. Because the mating ends 48 of the electrical contacts 46 are configured as receptacles that receive mating ends of electrical contacts of the complementary second electrical connector 24, the first electrical connector 22 can be referred to as a receptacle connector, though it should be appreciated that the first electrical connector 22 can alternatively be configured as a plug or header connector whereby the mating ends 48 are configured as plugs that are receive by the electrical contacts of the complementary second electrical connector 24.

At least one or more pairs of adjacent electrical contacts 46 can be configured as differential signal pairs 49. In accordance with one embodiment, the differential signal pairs 49 are edge coupled, that is the edges 47 of each electrical contact 46 of a given differential pair 49 face each other along a transverse common column 53 that is substantially perpendicular to the row direction 39. Thus, the leadframe assemblies 56 can be spaced along a longitudinal row direction 39, and the electrical contacts 46 of each leadframe assembly 56 are spaced along the respective column 53, such that the electrical contacts 46 of adjacent leadframe assemblies 56 are arranged in spaced substantially parallel columns 53. Thus, the first electrical connector 22 can include a plurality of differential signal pairs 49 arranged along a given column 53. The first electrical connector 22 can include any number of differential signal pairs 49 positioned edge-to-edge along the respective columns 53, though the first electrical connector 22 can include any number of differential signal pairs along a given column as desired, such as two, three, four, five, six, or more differential signal pairs.

As described above, the electrical contacts 46 can include a plurality of signal contacts S and a plurality of ground contacts G. Further, as described above, the leadframe assemblies 56 can include two different types of leadframe assemblies that are alternately arranged along the row direction 39. Each of the plurality of first leadframe assemblies 56*a* can include an arrangement of the electrical contacts 46 in a repeating G-S-S pattern along a direction from the top of the respective leadframe housing 58 toward the bottom of the respective leadframe housing 58 at the mating interface 42. Each of the plurality of second leadframe assemblies 56*b* can include an arrangement of the electrical contacts 46 in a repeating S-S-G pattern along a direction from the top of the respective leadframe housing 58 toward the bottom of the respective leadframe housing 58 at the mating interface 42. Thus, the first and second leadframe assemblies 56*a-b* can define different patterns of signal and ground contacts. Alternatively, the first and second leadframe assemblies 56*a-b* can define the same pattern of signal contacts S and ground contacts G. Adjacent pairs of signal contacts S of each leadframe assembly 56 can define differential signal pairs 49, or the signal contacts S can alternatively be single ended. It should be further appreciated that the mating interface 42 can define an open pin field, such that the ground contacts G can alternatively be provided as signal contacts that can have a data transfer speed that is different (for instance less) than that of the signal contacts S. Thus, reference herein to contacts G is made for illustrative purposes only, it being appreciated that the contacts G can be ground contacts as described above, or can alternatively provide signal contacts during operation.

With continuing reference to FIGS. 1A-B, the second electrical connector 26 includes a dielectric connector housing 31 that supports a plurality of electrical contacts 33, which can include signal contacts and ground contacts. The second electrical connector 26 defines a mating interface 61 configured to mate with the mating interface 42 of the first electrical connector 22 when the first and second electrical connectors 22 and 26 are mated. The second electrical connector further defines a mounting interface 63 that is configured to operatively engage the second substrate 28. As shown, the second electrical connector 26 can be a vertical electrical connector, whereby the mating interface 61 and the mounting interface 63 are oriented substantially parallel to each other, though it should be appreciated that the second electrical connector 26 can alternatively be a right-angle connector whereby the mating interface 61 and the mounting interface 63 are oriented substantially perpendicular to each other.

The electrical contacts 33 may be insert molded prior to attachment to the connector housing 31, stitched into the connector housing 31, or otherwise supported by the connector housing 31. The electrical contacts 33 define respective mating ends 65 that extend along the mating interface 61, and mounting ends 67 that extend along the mounting interface 63. Each of the electrical contacts 33 can define respective first and second opposed broadsides 69 and first and second edges 71 connected between the broadsides 69. The edges 71 define a length less than that of the broadsides 69, such that the electrical contacts 33 define a rectangular cross section. The mounting ends 67 may be press-fit tails, surface mount tails, or fusible elements such as solder balls, which are configured to electrically connect to a complementary electrical component such as the second substrate 28, which can be configured as a backplane, midplane, daughtercard, or the like.

At least one or more pairs of adjacent electrical contacts 33 can be configured as differential signal pairs 73. In accordance with one embodiment, the differential signal pairs 73 are edge coupled, that is the edges 71 of each electrical contact 33 of a given differential signal pair 73 face each other along a common column 75 that extends in the transverse direction T. Thus, the second electrical connector 26 can include a plurality of differential signal pairs 73 arranged along respective column 75. The second electrical connector 26 can include any number of differential signal pairs 73 as desired that can be positioned edge-to-edge along the respective common column 75.

Because the mating ends 65 of the electrical contacts 33 are configured as plugs that are configured to be received by the mating ends 48 of the electrical contacts of the complementary first electrical connector 22 when the first and second electrical connectors 22 and 26 are mated, the second electrical connector 26 can be referred to as a plug or header connector. Alternatively, the second electrical connector 26 can be provided as a receptacle connector whereby the mating ends 65 are configured to receive plugs of a complementary electrical connector that is to be mated with the second electrical connector 26.

The first and second electrical connectors 22 and 26 may be shieldless high-speed electrical connectors, i.e., connectors that are devoid of metallic crosstalk plates between the electrical contacts 46 of the adjacent leadframe assemblies 56, and can transmit electrical signals across differential pairs at data transfer rates at or above four Gigabits/sec, and typically anywhere at or between 6.25 through 12.5 Gigabits/sec or more (about 70 through 35 picosecond rise times) with acceptable worst-case, multi-active crosstalk on a victim pair of no more than six percent. Worst case, multi-active crosstalk may be determined by the sum of the absolute values of six or eight aggressor differential signal pairs that are closest to the victim differential signal pair, as described in U.S. Pat. No. 7,497,736. Each differential signal pair may have a differential impedance of approximately 85 to 100 Ohms, plus or minus 10 percent. The differential impedance may be matched, for instance, to the respective substrates 24 and 28 to which the first and second electrical connectors 22 and 26 may be attached. The first and second electrical connectors 22 and 26 may have an insertion loss of approximately −1 dB or less up to about a five-Gigahertz operating frequency and of approximately −2 dB or less up to about a ten-Gigahertz operating frequency.

Figure 3:
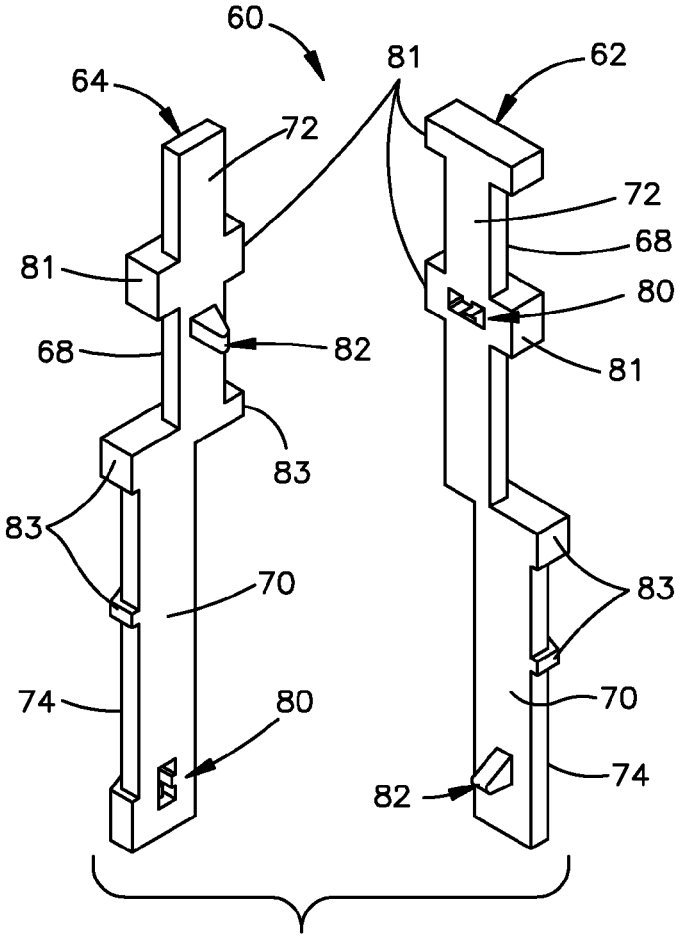
FIG. 3 is a perspective view of the first and second portions of the electrically conductive bar illustrated in FIG. 2.
Figure 4:
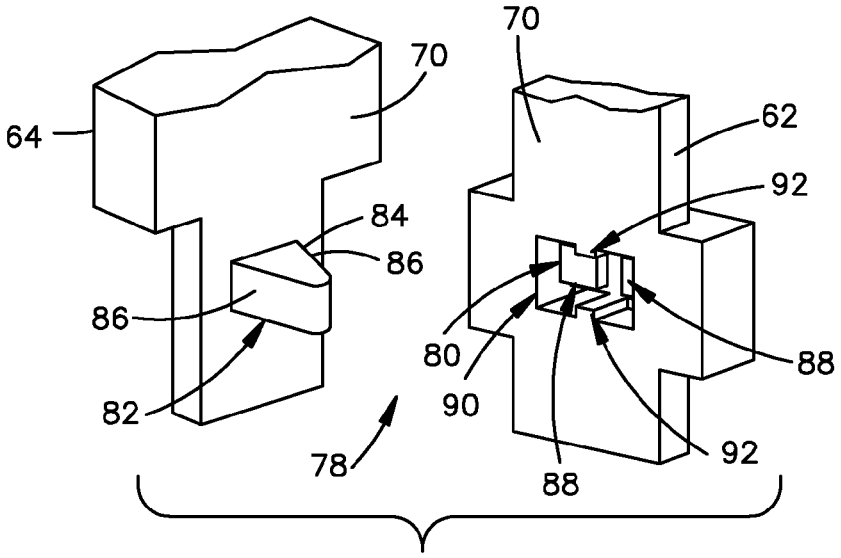
FIG. 4 is an enlarged perspective view of a select region of the first and second portions of the electrically conductive bar illustrated in FIG. 3 so as to illustrate a bias assembly.

Referring now to FIGS. 2A-3, the first electrical connector 22 further includes at least one an electrically conductive member illustrated as an electrically conductive bar 60, that includes a first portion 62 that can be electrically conductive and a second portion 64 that can be electrically conductive and separate from the first portion 62 and configured to engage the first portion 62. For instance, the electrically conductive bar 60, and thus the first and second portions 62 and 64, can be made from a conductive material, including a metal and/or a non-metallic conductive absorbing material, such as an electrically conductive lossy material. Alternatively, the electrically conductive bar 60 may also be electrically non-conductive but still be frequency absorbing.

Figure 5C:
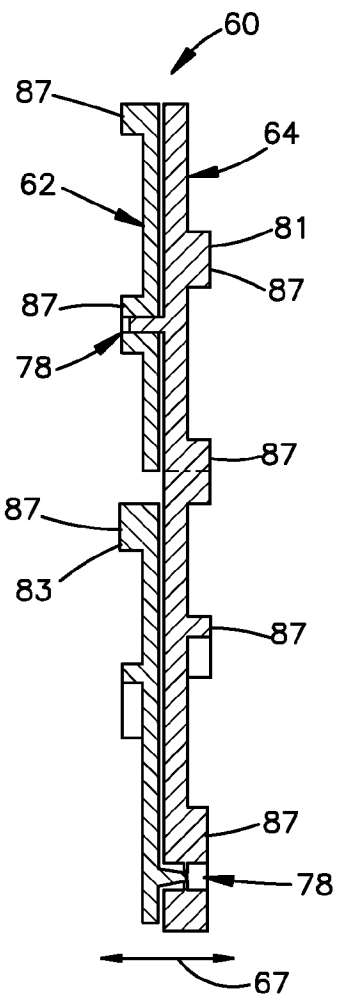
FIG. 5C is a sectional side elevation view of the electrically conductive bar illustrated in FIG. 5B, taken along line 5C-5C.
Figure 5B:
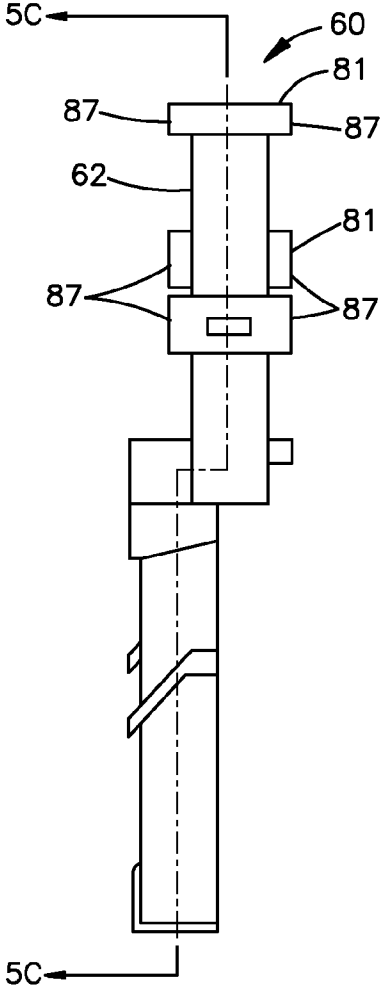
FIG. 5B is a side elevation view of the electrically conductive bar illustrated in FIG. 5A.
Figure 5A:
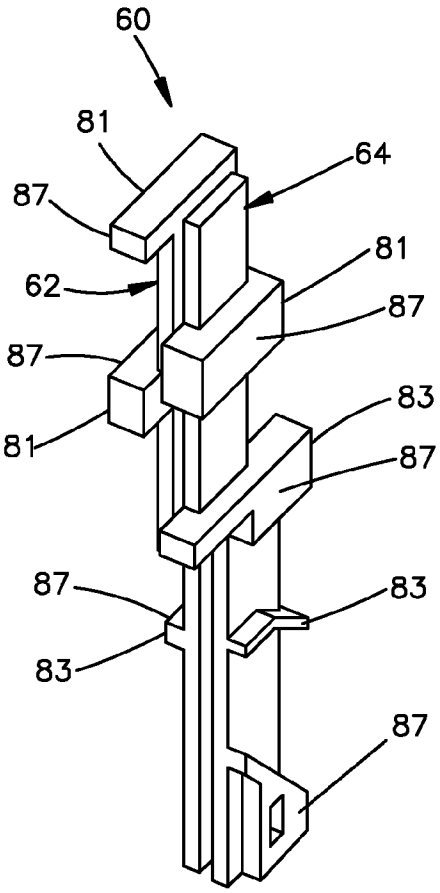
FIG. 5A is a perspective view of the first and second portions of the electrically conductive bar illustrated in FIG. 3, shown in an engaged configuration.

The first portion 62 is configured to be installed in a first select one of the leadframe assemblies 56 and supported by the respective leadframe housing 58, and a second portion 64 that is configured to be installed in a second select one of the leadframe assemblies 56 and supported by the respective leadframe housing 58. Thus, one of the leadframe assemblies 56 can include one of the first and second portions 62 and 64, and another one of the leadframe assemblies 56 can include the other of the first and second portions 62 and 64. The first select one of the leadframe assemblies 56 can be disposed adjacent to the second select one of the leadframe assemblies 56, such that no other leadframe assembly is disposed between the first and second select ones of the leadframe assemblies 56 along the row direction 39. The first and second portions 62 and 64 of the electrically conductive bar can engage such that each of the first and second portions 62 and 64 can bias the other of the first and second portions 62 and 64 apart along the row direction 39, for instance as indicated by Arrow 67 (FIG. 5C). Accordingly, each of the first and second portions 62 and 64 of the electrically conductive bar is biased toward the respective electrical contacts 46, and in particular toward the ground contacts G, of the respective leadframe assembly 56. The first and second select adjacent leadframe assemblies 56 can be provided as the first IMLA type 56*a* and the second IMLA type 56*b*. For instance, in accordance with one embodiment, the first select one of the leadframe assemblies 56 can be one of the first and second pluralities of the leadframe assemblies 56*a-b*, and the second select one of the leadframe assemblies 56 can be the other of the first and second pluralities of the leadframe assemblies 56*a-b*.

The leadframe housings 58 of the leadframe assemblies 56 each defines a respective pocket 66 at a location proximate to the mating end 48 of the electrical contacts 46, though it should be appreciated that the pocket 66 can be disposed anywhere along the leadframe assembly 56. The pocket 66 can have a length in the transverse direction T that extends across at least one ground contact G, such as a plurality, for instance all, of the ground contacts G of the respective leadframe assembly 56. In accordance with the illustrated embodiment, the pocket 66 spans across all electrical contacts 46 of the respective leadframe assembly 56. The pockets 66 are sized to receive one of the first and second portions 62 and 64 of the electrically conductive bar 60. The pockets 66 can include a first upper portion 66*a* and a second lower portion 66*b* that is offset with respect to the first upper portion 66*a* along the longitudinal direction L. For instance, the upper and lower portions 66*a* and 66*b* can extend parallel to each other, along the transverse direction T and thus substantially parallel to the column 53 in accordance with the illustrated embodiment, and the lower portion 66*b* can be disposed forward with respect to the upper portion 66*a* along the longitudinal direction L.

In accordance with the illustrated embodiment, the pocket 66 of the first select one of the leadframe assemblies 56 can extend laterally into the first outer surface 55 of the respective leadframe housing 58, and the pocket 66 of the second select one of the leadframe assemblies 56 that is disposed adjacent the first select one of the leadframe assemblies 56 can extend laterally into the second outer surface 57 of the respective leadframe housing 58 that faces the first outer surface of the leadframe housing 58 of the first select one of the leadframe assemblies 56.

As illustrated in FIG. 3, the first portion 62 and the second portion 64, and thus the bar 60, can be made from any suitable conductive material, such as a metal, conductive plastic, or any suitable alternative conductive material. Alternatively or additionally, the bar 60 can be made from a conductive or nonconductive electrical absorbing material, such as a lossy material. Each of the first and second portions 62 and 64 can define a first or inner surface 68 and an opposed second or outer surface 70 that is spaced from the inner surface along the lateral row direction 39. The inner surface 68 can face the electrical contacts 46 of the respective leadframe assembly 56, and the outer surface 70 of each of the first and second portions 62 and 64 of each bar 60 can face the outer surface 70 of the other of the first and second portions 62 and 64 of the bar 60, such that the first electrical connector 22 is devoid of electrical contacts between the first and second portions 62 and 64 that are installed in adjacent first and second leadframe assemblies 56*a* and 56*b*, and can be devoid of electrical contacts between the outer surfaces 70 of the first and second portions 62 and 64 that are installed in adjacent first and second leadframe assemblies 56*a* and 56*b*, for instance when at least one or both of the first and second portions 62 and 64 each comprise a lossy material. For instance, in accordance with one embodiment, a majority of the outer surfaces 70 of the first and second portions 62 and 64 that are installed in adjacent first and second leadframe assemblies 56*a* and 56*b* are separated by only air. Thus, the outer surfaces 70 of the first and second portions 62 and 64 that are installed in adjacent first and second leadframe assemblies 56*a* and 56*b* can touch each other, or can be spaced from each other along the row direction 39. It should be further appreciated that when the first and second portions 62 and 64 of the bar 60 comprise a lossy material, the bar 60 can be devoid of the bias assembly 78, and the first and second portions 62 and 64 can thus be devoid of the bias members 80 and 82. The first and second portions 62 and 64 can be mirror images of each other, such that the upper and lower portions 72 and 74 of the first portion 62 is aligned with the upper and lower portions 72 and 74 of the second portion 64 when the respective outer surfaces 70 face each other. At least one or both of the inner and outer surfaces 68 and 70 can be substantially planar, or contoured as desired such that regions on the first and second portions 62 and 64 are closer to the ground contacts G than the signal contacts S of the respective leadframe assembly 56.

Each portion 62 and 64 defines an upper end 72 and a lower end 74 that is offset with respect to the upper end 72 along the longitudinal direction L so as to correspond to the shape of the pockets 66. For instance, the upper and lower ends 72 and 74 can extend parallel to each other, along the transverse direction T and substantially parallel to the column 53 in accordance with the illustrated embodiment, such that the lower end 74 is forwardly spaced from the upper end 72 along the longitudinal direction L. The first and second portions 62 and 64 can be retained in the respective pockets in any manner as desired. In accordance with the illustrated embodiment, the leadframe assemblies 56 can each include at least one retention member such as a first protrusion 81 that extends longitudinally out from the upper portion 72 and at least one second protrusion 83 that extends longitudinally out from the lower portion 74. For instance, each of the first and second portions 62 and 64 can include a pair of first protrusions 81 that extend forward and rearward, respectively, from the upper portion 72 along the longitudinal direction L, and are configured to be press-fit in the respective pocket 66 such as at the upper portion 66*a*.

The first protrusions 81 can define a pair of first protrusions 81 that can be aligned with each other as illustrated, or offset with each other along the transverse direction T as desired. Furthermore, each of the first and second portions 62 and 64 can include a pair of second protrusions 83 that extend forward from the lower portion 74 along the longitudinal direction L. One of the pair of second protrusions 83 can extend through a gap 85 of the respective leadframe housing 58 that is open to the pocket 66, while the other of the second protrusions 83 can be sized so as to be press-fit in the pocket 66 such as at the lower portion 66*b*. Alternatively or additionally, the portions 62 and 64 can staked, latched, glued, or otherwise fixed to the respective leadframe housings 58 in the pockets 66. Alternatively, the portions 62 and 64 can be trapped between the leadframe assemblies 56 once the leadframe assemblies 56 are secured to the connector housing 30 without first fixing the portions 62 and 64 to the leadframe housings 58. When the first and second portions 62 and 64 are fully inserted into the respective pockets 66, the outer surfaces 70 can be recessed from, flush with, or extend out from the leadframe housing 58.

In accordance with one embodiment, the portions 62 and 64 can be fully inserted in the respective pockets 66 to a depth at a location closely spaced to the ground contacts G. For instance, when the portions 62 and 64 are fully seated in the pockets 66, a desired non-zero lateral gap extends along the lateral direction L between the inner surfaces 68 of the first and second portions 62 and 64 and the respective electrical contacts 46 (e.g., ground contacts G). In accordance with one embodiment, the gap can be between 0.001 inch and 0.005 inch, for instance approximately 0.002 inch. Thus, the portions 62 and 64 are not placed in contact with the electrical contacts 46, but are placed in close proximity to the electrical contacts 46, and in particular the ground contacts G of the respective leadframe assembly 56. Accordingly, the first and second portions 62 and 64 do not touch the ground contacts G when the first and second portions 62 and 64 are fully seated in the respective pockets 66.

In accordance with one embodiment, each pocket 66 can define a depth that extends laterally into the respective leadframe housing 58 from the respective first and second outer surfaces 55 and 57 that is less than the distance between the respective first and second outer surface 55 and 57 and the respective electrical contacts 46. As a result, when the electrically conductive bars 60 are fully seated in the respective pockets 66, the bars 60 do not contact the electrical contacts 46 and are spaced from the electrical contacts 46 by the lateral gap. Alternatively or additionally, at least one or more up to all of the projections 81 and 83 can also extend laterally out from the upper and lower ends 72 and 74 as desired. The projections 81 and 83 can be an electrically nonconductive dielectric material, and for instance can be overmolded onto the first and second portions 62 and 64, and can have a lateral thickness substantially equal to the lateral gap. In this regard, it should be appreciated that the projections 81 and 83 can define dielectric spacer members 87 that space the first and second portions 62 and 64 from the respective electrical contacts 46, including at least one up to all of the ground contacts G. Alternatively or additionally, the spacer members 87 can be defined by the leadframe housing 58 that separates the electrical contacts 46 from the first and second portions 62 and 64. It should be further appreciated that the first and second portions 62 and 64 could be configured to contact the respective ground contacts G (e.g., such that the lateral gap is zero), thereby establishing a continuous ground path across the ground contacts G, for instance once the first and second portions 62 and 64 are fully seated in the respective pockets 66.

Referring now to FIGS. 3-5C, the conductive bar 60 includes a bias assembly 78 that is configured to bias the portions 62 and 64 laterally toward the electrical contacts 46 of the respective leadframe assemblies 56 and away from each other. In particular, the bias assembly 78 includes at least one pair of first and second complementary bias members 80 and 82. As illustrated, one of the first and second portions 62 and 64 can carry the first bias member 80, and the other of the first and second portions 62 and 64 can carry the second bias member 82. The first and second bias members 80 and 82 are configured to engage each other so as to bias the first and second portions 62 and 64 laterally away from each other and toward the electrical contacts 46 of the respective leadframe assembly 56.

The first and second bias members 80 and 82 can be constructed in any manner desired so as to apply a biasing force of against the first and second portions 62 and 64, respectively. In accordance with the illustrated embodiment, one of the first and second portions 62 and 64, for instance the outer surface 70 of one of the first and second portions 62 and 64, can carry one or both of the first and second bias members 80 and 82, while the other of the first and second portions 62 and 64, for instance the outer surface 70 of the other of the first and second portions 62 and 64, can carry the other or both of the first and second bias members 80 and 82. The first bias member 80 is illustrated as at least one bias tab 88, such as a pair of bias tabs 88 that are longitudinally spaced and disposed in a recess 90 that extends into the outer surface 70. The second bias member 82, which can be in the form of a projection 84 that extends from the outer surface 70 and defines opposed sloped outer cam surfaces 86 that are tapered toward each other toward as they extend toward the other of the first and second portions 62 and 64. The projection 84 can be sized to be received between the bias tabs 88 which can be deflectable away from each other, and are spaced so as to deflect away from each other as the tapered cam surface 86 is inserted between the bias tabs 88.

In accordance with the illustrated embodiment, the first portion 62 carries the first bias member 80, and the second portion 64 carries the second bias member 82, though it should be appreciated that the first portion 62 can carry the second bias member 82, and the second portion 64 carries the first bias member 80. As the bias tabs 88 deflect, they impart a spring force onto the cam surfaces 86. Because the cam surfaces 86 are sloped with respect to the lateral direction A, the longitudinal force imparted onto the cam surfaces 86 by the bias tabs 88 biases the projection 84 away from the bias tabs 88, and thus biases the corresponding second portion 64 laterally toward the respective electrical contacts 46. A substantially equal and opposite lateral force is imparted from the projection 84 onto the bias tabs 88, which biases the corresponding first portion 62 in a direction toward the respective electrical contacts 46. Accordingly, the bias assembly 78 biases the first and second portions 62 and 64 toward the respective electrical contacts 46 to a fully seated position inside the respective pockets 66, such that the spacer members 87 define the desired lateral gap between the respective first and second portions 62 and 64 and the respective electrical contacts 46.

At least one of the first and second portions 62 and 64, for instance the first portion 62 as illustrated, can further include at least one alignment rib 92 such as a pair of opposed upper and lower alignment ribs 92 that are aligned with the upper and lower surfaces of the bias tabs 88. Accordingly, the alignment ribs 92 provide a guide that maintains the projection 84 in alignment with the bias tabs 88 when the portions 62 and 64 are engaged. It should thus be appreciated that the bias assembly 78 is configured to align the first and second portions 62 and 64 of the conductive member 60 in the lateral, longitudinal, and transverse directions. Furthermore, the pockets 66 and the bias assembly 78 can cooperate to ensure that the first and second portions 62 and 64 of the conductive members 60 are not inadvertently displaced along the longitudinal L or transverse T directions during operation.

During operation, the first and second portions 62 and 64 are inserted into the pockets 66 of the respective leadframe assemblies 56 such that the respective first and second bias members 80 and 82 face each other and are aligned with each other. Next, the leadframe assemblies 56 are mounted to the connector housing 30 such that the bias members 80 and 82 of the portions 62 and 64 engage, which produces a force against both portions 62 and 64 that biases the portions 62 and 64 toward the respective electrical contacts 46, which causes the portions 62 and 64 to remain fully seated in their respective pockets 66 such that the respective inner surfaces 68 are maintained in a position spaced from the electrical contacts 46 by the desired gap. The portions 62 and 64 can alternatively be mechanically fastened to the leadframe housing 58 at a desired depth prior to installing the leadframe assemblies 56 in the connector housing 30, such that inner surfaces 68 are spaced from the electrical contacts 46 by the desired gap even though the first electrical connector 22 can be devoid of the bias assembly 78. It is believed that the conductive bar 60 increases signal integrity of the first electrical connector by providing resonance dampening, which reduces cross talk produced during operation of the electrical connector system 20.

Thus, in accordance with one embodiment, a method can be provided for reducing cross-talk of an electrical connector. The method can include the step of providing or teaching the use of an electrical connector, such as the first electrical connector 22 having the connector housing 30 and a plurality of leadframe assemblies 56 supported by the connector housing 30. The method can further include the step of identifying first and second adjacent leadframe assemblies 56 of the electrical connector, and teaching the step of creating a pocket, such as the pocket 66, in opposed first and second outer surfaces 55 and 57 of first and second leadframe housings of the first and second leadframe assemblies 56, respectively, such that the opposed first and second outer surfaces 55 and 57 face each other when the first and second leadframe assemblies 56 are supported by the connector housing 30. The method can further include teaching the step of disposing, for instance inserting, first and second electrically conductive portions, such as the first and second portions 62 and 64, of a conductive bar, such as the bar 60, in the pockets of the first and second leadframe assemblies 56, respectively. The first and second portions 62 and 64 are separated from the electrical contacts 46 of each of the leadframe assemblies 56 by a non-zero gap that can be sized as desired, for instance between 0.001 inches and 0.005 inches, such as 0.002 inches.

The embodiments described in connection with the illustrated embodiments have been presented by way of illustration, and the present invention is therefore not intended to be limited to the disclosed embodiments. Furthermore, the structure and features of each the embodiments described above can be applied to the other embodiments described herein, unless otherwise indicated. For instance, it should be appreciated that the first and second portions 62 and 64 can alternatively be integrally connected or discretely connected such that the bar is unitary prior to insertion into the pockets 66. Alternatively or additionally, it should be appreciated that while the first and second select leadframe assemblies 56 define pockets 66 in the opposed first and second outer surfaces 55 and 57 that face each other, the first and second select leadframe assemblies 56 can define pockets 66 on the same side of the leadframe housing 58 along the connector 22, such adjacent that the pockets 66 of the adjacent leadframe assemblies 56 do not face each other. Rather, the first and second portions 62 and/or 64 can be inserted into the respective pocket 66 so as to be disposed adjacent a surface 55 or 57 of the adjacent leadframe assembly 56 that does not include a pocket 66. Accordingly, those skilled in the art will realize that the invention is intended to encompass all modifications and alternative arrangements included within the spirit and scope of the invention, for instance as set forth by the appended claims.

What is claimed:

1. An electrical connector comprising:

a connector housing;

a first leadframe assembly supported by the connector housing, the first leadframe assembly including a first leadframe housing and a corresponding plurality of electrical contacts carried by the first leadframe housing that are configured to transmit data signals;

a second leadframe assembly that is adjacent to the first leadframe assembly, the second leadframe assembly including a second leadframe housing and a corresponding plurality of electrical contacts carried by the second leadframe housing that are configured to transmit data signals;

an electrically conductive member including a first portion and a second portion, the first portion supported by the first leadframe housing so as to define a gap with respect to the plurality of electrical contacts corresponding to the first leadframe assembly, and the second portion supported by the second leadframe housing so as to define a gap with respect to the plurality of electrical contacts corresponding to the second leadframe assembly, wherein each leadframe housing of the first and second leadframe assemblies define respective pockets that receive the first and second portions, respectively and the first and second portions face each other when the first and second leadframe assemblies are supported by the connector housing, such that the electrical connector is devoid of electrical contacts between the first and second portions.

2. The electrical connector as recited in claim 1, wherein the gap is between 0.001 inches and 0.005 inches.

3. The electrical connector as recited in claim 1, further comprising a dielectric spacer member that maintains each of the first and second portions at a location spaced from the respective electrical contacts by the respective gap.

4. The electrical connector as recited in claim 3, wherein the dielectric spacer member comprises a dielectric material that extends out from each of the first and second portions.

5. The electrical connector as recited in claim 1, wherein the first and second leadframe assemblies are spaced along a row direction, and the electrical contacts of each of the first and second leadframe assemblies are spaced along a column direction that is substantially perpendicular to the row direction.

6. The electrical connector as recited in claim 5, wherein each of the first and second portions includes a first end and a second end that extend substantially parallel to the column of the respective leadframe assembly.

7. The electrical connector as recited in claim 6, wherein one of the first and second ends is offset with respect to the other of the first and second ends along a direction that is substantially perpendicular to both the row and column directions.

8. The electrical connector as recited in claim 1, wherein the electrical contacts of each of the first and second leadframe assemblies each define a mounting end configured to electrically connect to a complementary electrical component and a mating end configured to mate with a complementary electrical connector, and the first and second portions are disposed proximate to the mating ends of the electrical contacts of the respective leadframe assembly.

9. The electrical connector as recited in claim 1, wherein the conductive member further comprises a bias assembly that biases the first and second portions of the conductive member away from each other and toward the electrical contacts of the respective leadframe assembly.

10. The electrical connector as recited in claim 9, wherein the bias assembly comprises a projection that extends out from one of the first and second portion, and a pair of bias tabs carried by the other of the first and second portions, the bias tabs configured to receive the projection and apply a force to the projection that biases the projection away from the bias tabs.

11. The electrical connector as recited in claim 10, wherein bias tabs are deflectable away from each other when the projection is received between the bias tabs.

12. The electrical connector as recited in claim 1, wherein the electrical connector is devoid of a metallic crosstalk plate between the electrical contacts of the first and second leadframe assemblies.

13. The electrical connector as recited in claim 1, wherein the electrical contacts of each of the first and second leadframe assemblies include at least one differential signal pair and at least one ground contact disposed adjacent the differential signal pair.

14. The electrical connector as recited in claim 1, wherein each of the first and second portions comprises a lossy material.

15. An electrical connector comprising:

a connector housing;

a first leadframe assembly supported by the connector housing, the first leadframe assembly including a first leadframe housing and a corresponding plurality of electrical contacts carried by the first leadframe housing that are configured to transmit data signals;

a second leadframe assembly that is adjacent to the first leadframe assembly, the second leadframe assembly including a second leadframe housing and a corresponding plurality of electrical contacts carried by the second leadframe housing that are configured to transmit data signals;

an electrically conductive member including a first portion and a second portion, the first portion supported by the first leadframe housing so as to define a gap with respect to the plurality of electrical contacts corresponding to the first leadframe assembly, and the second portion supported by the second leadframe housing so as to define a gap with respect to the plurality of electrical contacts corresponding to the second leadframe assembly, wherein the first and second portions face each other when the first and second leadframe assemblies are supported by the connector housing, such that the electrical connector is devoid of electrical contacts between the first and second portions, and the conductive member further comprises a bias assembly that biases the first and second portions of the conductive member away from each other and toward the electrical contacts of the respective leadframe assembly.

16. The electrical connector as recited in claim 15, wherein the bias assembly comprises a projection that extends out from one of the first and second portion, and a pair of bias tabs carried by the other of the first and second portions, the bias tabs configured to receive the projection and apply a force to the projection that biases the projection away from the bias tabs.

17. The electrical connector as recited in claim 16, wherein bias tabs are deflectable away from each other when the projection is received between the bias tabs.

18. An electrical connector comprising:

a connector housing;

a first leadframe assembly supported by the connector housing, the first leadframe assembly including a first leadframe housing and a first plurality of electrical contacts carried by the first leadframe housing;

a second leadframe assembly that is adjacent to the first leadframe assembly, the second leadframe assembly including a second leadframe housing and a second plurality of electrical contacts carried by the second leadframe housing, each leadframe housing of the first and second leadframe housings having an ultimate height along a transverse direction and an ultimate width along a longitudinal direction, perpendicular to the transverse direction;

an electrically conductive member including a first portion and a second portion, the first portion supported by the first leadframe housing so as to define a gap with respect to the first plurality of electrical contacts along a lateral direction, perpendicular to the transverse and longitudinal directions, and the second portion supported by the second leadframe housing so as to define a gap with respect to the second plurality of electrical contacts along the lateral direction, each portion of the first and second portions defining an ultimate height of the portion along the transverse direction and an ultimate width of the portion along the longitudinal direction, wherein at least one of (i) the ultimate width of the portion is less than the ultimate width of the housing and (ii) the ultimate height of the portion is less than the ultimate height of the housing.

19. The electrical connector as recited in claim 18, wherein the ultimate width of the portion is less than the ultimate width of the housing.

20. The electrically connector as recited in claim 19, wherein the ultimate height of the portion is less than the ultimate height of the housing.

21. The electrical connector as recited in claim 18, wherein the ultimate width of the portion is less than the ultimate height of the portion.

22. The electrical connector as recited in claim 18, wherein each electrical contact of the first and second pluralities of electrical contacts includes a mounting end and a mating end, and the first and second portions are supported proximate to the mating ends and terminate without extending to the mounting ends along the longitudinal direction.

* * * * *